US009226361B2

(12) United States Patent
Toth

(10) Patent No.: US 9,226,361 B2
(45) Date of Patent: Dec. 29, 2015

(54) INTRINSICALLY SAFE DISPLAY DEVICE WITH AN ARRAY OF LEDS

(75) Inventor: Ferencz Nandor Toth, Delft (NL)

(73) Assignee: EUROPEAN INTELLIGENCE B.V., Dordrecht (NL)

( * ) Notice: Subject to any disclaimer, the term of this patent is extended or adjusted under 35 U.S.C. 154(b) by 281 days.

(21) Appl. No.: 13/876,542

(22) PCT Filed: Sep. 29, 2011

(86) PCT No.: PCT/NL2011/050660

§ 371 (c)(1),
(2), (4) Date: May 31, 2013

(87) PCT Pub. No.: WO2012/044169

PCT Pub. Date: Apr. 5, 2012

(65) Prior Publication Data

US 2013/0241416 A1 Sep. 19, 2013

(30) Foreign Application Priority Data

Sep. 29, 2010 (NL) ..... 2005418

(51) Int. Cl.
*H05B 33/08* (2006.01)
*G09G 3/32* (2006.01)

(52) U.S. Cl.
CPC ..... *H05B 33/0887* (2013.01); *H05B 33/089* (2013.01); *H05B 33/0821* (2013.01); *G09G 3/32* (2013.01); *G09G 2330/045* (2013.01)

(58) Field of Classification Search
USPC ..... 315/127–128, 307, 309
See application file for complete search history.

(56) References Cited

U.S. PATENT DOCUMENTS

| | | | | |
|---|---|---|---|---|
| 6,979,100 | B2 | 12/2005 | Reiff et al. | |
| 7,317,287 | B2 * | 1/2008 | Blumel | 315/291 |
| 7,420,335 | B2 * | 9/2008 | Robinson et al. | 315/308 |
| 8,779,685 | B2 * | 7/2014 | Wang et al. | H05B 33/0812 315/294 |
| 2006/0012997 | A1 | 1/2006 | Catalano et al. | |
| 2008/0083929 | A1 | 4/2008 | Fan et al. | |

FOREIGN PATENT DOCUMENTS

| | | | |
|---|---|---|---|
| CN | 101581443 | A | 11/2009 |
| DE | 102004047682 | A1 | 4/2006 |
| EP | 0891120 | A1 | 1/1999 |
| EP | 2066149 | A2 | 6/2009 |
| WO | WO-2009/061028 | A1 | 5/2009 |

OTHER PUBLICATIONS

Bourns; *MF-MSMF Series—PTC Resettable Fuses*; article; Jan. 27, 2003; pp. 1-5.

* cited by examiner

*Primary Examiner* — An Luu
(74) *Attorney, Agent, or Firm* — Miller, Matthias & Hull LLP

(57) ABSTRACT

An intrinsically safe LED display device with an array of LED circuit cells is provided. Each cell comprises a LED or a group of LEDs, which are individually made intrinsically safe in a conventional way, by limiting a dissipated power through the LED circuit cell by means of a resistor or group of resistors in series with the LED or group of LEDs. In addition a switching type PTCs with a switching temperature between 80 and 125 degrees centigrade are added in each cell, in series with the resistors or group of resistors of the LED circuit cells respectively, in thermal contact with the resistor or group of resistors of the LED circuit cell. In this way intrinsic safety is provided for mutual heating of adjoining LED circuit cells wherein the LEDs or groups of LEDs are short circuited.

17 Claims, 2 Drawing Sheets

INTRINSICALLY SAFE DISPLAY DEVICE WITH AN ARRAY OF LEDS

CROSS-REFERENCE TO RELATED APPLICATIONS

This application is a 35 USC §371 U.S. national stage filing of International Patent Application No. PCT/NL2011/050660 filed on Sep. 29, 2011, which claims priority under the Paris Convention and 35 USC §119 to Netherland Patent Application No. 2005418, filed on Sep. 29, 2010.

FIELD OF THE DISCLOSURE

The invention relates to an intrinsically safe (I.S.) LED display device with an array of LEDs that is designed to provide intrinsic safety in potentially explosive environments.

BACKGROUND OF THE DISCLOSURE

LED display devices with arrays of LEDs have daylight display capabilities and are able to provide for relatively large displays that can be read from a distance at industrial sites.

Intrinsic safety (I.S.) is a design requirement in the art, used for electronic equipment for use at industrial sites such as oil terminals and mines, where normal operating conditions or spilling may give rise to the presence of inflammable or explosive gases. U.S. Pat. No. 7,312,716, for example discusses intrinsically safe designs of wireless communication network equipment. Intrinsically safe devices that use LEDs are used in U.S. Pat. No. 6,979,100, which involves intrinsically safe LED lighting, and U.S. Pat. No. 7,420,471, which uses a LED display to provide warning signals in a mine. As used herein, an intrinsically safe LED display is a LED display that is designed according to a requirement for intrinsic safety.

Research into possible causes of explosions has provided design rules for providing intrinsic safety. In some cases it is necessary to encapsulate electronic equipment to provide intrinsic safety. But it is also possible to provide intrinsic safety with equipment that has exposed components.

One important consideration for intrinsic safety is maximum component surface temperature. Research has shown that for most classes of explosive gases components with large surfaces that are exposed to gases from the environment are safe if their temperature remains below 135 degrees centigrade. For smaller surfaces, higher temperatures are allowed. Design requirements for intrinsic safety allow a temperature of 200 degrees centigrade for surfaces with an area of less than 2000 square millimetres, and if the area is that of a resistor, the design requirement for such areas is that the resistor dissipates less than 1.3 (in an ambient of no more than 40 degree centigrade, 1.1. Watt in ambients up to 80 degrees). For areas of less than 20 square millimetres a temperature of 275 degrees centigrade is allowed To provide for intrinsic safety, circuits should be designed so that these requirements are met both under normal operation and during conceivable malfunctions.

A conventional design solution to provide intrinsic safety is to put resistors in series with any circuit path that could be short-circuited due to malfunction, if the short-circuit could give rise to a temperatures above safe level. Such resistors serve to limit the dissipated power. Because a resistor will become the hottest point in the case of a short circuit of the protected circuit path, limitation by the resistor provides intrinsic safety without any dependence on proper operation of detectors, provided that the resistor does not dissipate so much power that it violates intrinsic safety requirements. The resistor values are typically chosen to limit power dissipation in the resistor to less than 1.1 Watt under normal and malfunction conditions. Usually resistors of less than 2000 square millimetre area are used. This means that the resistors temperature need not be limited to the 135 degree centigrade requirement that applies to large surface areas. It has been found that in an environment at less than 40 degrees centigrade a power dissipation from such resistors of no more than 1.3 Watt ensures intrinsically safe conditions (1.1 Watt in environments up to 80 Centigrade). In addition, power dissipation is kept below ⅔ of the power rating of the resistor to prevent that the risk of failure of the resistor exceeds an intrinsically safe level. Furthermore, intrinsically safe circuits use Zener barriers containing fuses in the safe area to limit the voltage, current and power supplied to such electronic circuits in the case of equipment failure, to ensure that the power levels never becomes sufficient to produce temperatures that give rise to an explosion risk.

It is desirable to provide for Intrinsically Safe LED display devices with a 2 dimensional array of LEDs, because of their daylight display capabilities and their ability to provide for relatively large displays that can be read from a distance at the industrial site (as used herein an array can be a matrix with rows and columns, but also other arrangements with rows of LEDs, such as a linear array with a single row of LED circuit cells, or 7 segment digit display arrangements, wherein the segments comprise rows of LEDs).

At the same time, it is desirable that the intrinsic safety of the LED display device should not prevent it from functioning as much as possible. For example, if the LED display device is used to indicate information that is needed to maintain safety in a mine or at an oil terminal, it is undesirable that more than a minimum number of LEDs or even the entire LED display device would switch off because some of its LEDs fail in a way that lead to a safety risk.

To provide for intrinsic safety of a LED in combination with continued operation, conventional protective series resistors may be used in series with individual circuit paths containing LEDs. However, this conventional approach does not provide for intrinsic safety in a LED display device wherein a large number of LEDs in parallel circuit paths is used in close proximity with each other. Intrinsic safety requires that such a display device cannot reach unsafe temperatures even if all LEDs short circuit simultaneously. When a plurality of mutually adjacent LEDs in a small area fails in this way, the maximum power available to the LED display device is dissipated in the protective current limiting resistors in the small area. It has been found that in this case the combined effect of the resistors can cause the maximum surface temperature to exceed the allowable limit, even if the power dissipated by each individual resistor remains below the safe value of 1.3 Watt (1.1 Watt in 80 degree environments).

EP 891 120 discloses the use of a PTC in series with a set of LED's to protect against destruction due to voltage rises. When the voltage rises, current increases, heating the PTC, which in turn leads to an increased resistance that reduces the current. EP 891 120 uses one PTC for a plurality of LEDs. The document does not discuss LED arrays in displays that have at least rows of LEDs that are fed from a power supply. But of course the LEDs of such a display could also be protected against voltage surges by a PTC. However, the document gives no reason to do so on a pixel by pixel basis for each pixel and of course there is no need to protect the LEDs if the power supply itself is designed to prevent voltage surges.

US 2007/139928 discloses the use of a PTC in series with a LED to protect against destruction due to excessive heating. The document does not discuss LED display arrays, with at least rows of LEDs that are fed from the same power source. The document gives no reason to protect LEDs on a pixel by pixel basis with different PTCs for each pixel and of course there is no need to protect the LEDs if the power supply itself is designed to prevent voltage surges.

CN 101 581 443 confirms that intrinsic safety has been considered for lighting devices that contain a single LED.

SUMMARY OF THE DISCLOSURE

Among others, it is an object to provide for an intrinsically safe design of a LED display device.

A LED display device according to claim 1 is provided. This device generates light from an array of LED circuit cells, each LED circuit cell comprising a LED or group of LEDs, and a resistor or group of resistors in series with the LEDs. The resistors perform a current limiting function to provide for intrinsic safety of individual LED circuit cells. In each LED circuit cell, a switching type PTC is connected in series with the group of resistors, in thermal contact with the resistors. In an embodiment the resistors and the switching type PTC provide for a double protection. In this embodiment the resistors are selected to provide intrinsic safety in the case of failure in the LED circuit cell per se, by limiting the current to a level at which the resistors do not heat to an unsafe level, and the switching type PTC switches the current off only when added heat from adjoining malfunctioning LED circuit cells raises the temperature further.

The display device may comprise a power supply circuit coupled to the electrical series arrangements of the LED circuit cells, wherein the power supply circuit is arranged to keep the power supply voltage below a predetermined value. With such a power source, there is no need to protect LEDs against overvoltage or overheating due to power supply current, because the power supply circuit prevents overvoltage. The limitation to the predetermined value may be realized by a voltage limiting circuit, which may itself contain a PTC, and thus the power supply circuit prevents overvoltage for all LED circuit cells in the array. But still each of the LED circuit cell contains its own switching type PTC to provide for intrinsic safety. Typically, the maximum power supply voltage value is equal to the nominal voltage value of normal operation at which the LEDs are of course not destroyed by overvoltage. The maximum power supply voltage allowed by the power supply circuit may be slightly higher than the nominal voltage, but of course still below the voltage at which the risk of destruction due to overvoltage becomes significant.

In an embodiment, the switching type PTC comprises an electrically non-conductive polymer matrix with embedded grains of electrically conductive material that are kept in electric contact with each other by the polymer matrix below the switching temperature. The switching type PTC has a switching temperature at which its resistance rises sharply, in the example of a polymer matrix because contact between the grains is lost. A switching type PTC of each LED circuit cell with a switching temperature between 80 and 125 degrees centigrade is used. More preferably a switching temperature below 120 degrees centigrade is used. This eases tolerances.

To provide intrinsic safety, the local temperature on the LED display device on large surfaces should not exceed 135 degrees centigrade, although it may be higher locally in resistors. The temperatures could arise due to dissipation of electric power through the LED circuit cells into heat. In normal operation a significant part of the power associated with the current through the LED circuit cell is converted into light by the LED or LEDs. A part of the power is converted into heat, mainly by the resistors, but in normal operation this part is too small to raise the local temperature at the switching type PTC above the switching temperature. In the case of failure, the LED or LEDs may stop converting power into light, in which case the voltage drop across the LED or LEDs may fall and more electrical power will be converted into heat.

If single LED circuit cell fails the resistor or group of resistors limits the current in the LED circuit cell provide for intrinsic in the conventional way, so that the LED circuit cell by itself cannot give rise to a dangerous temperature. The same goes for adjacent surrounding LED circuit cells by themselves. However, if the LEDs of adjacent surrounding LED circuit cells of a particular LED circuit cell also fail, heat from the resistors of these LED circuit cells also flows to the resistors and switching type PTC of the particular LED circuit cell or, in other words, heat from the particular LED circuit is less efficiently removed. When this results in a temperature rise at the switching type PTC to the switching temperature, the switching type PTC limits the current. It has been found that in this way the local temperature of the LED circuit cell can be limited in an intrinsically safe way also when adjacent LED circuit cells in a small area fail.

In an embodiment the resistor or group of resistors of each LED circuit cell has a resistance value so that heat dissipated in the LED circuit cell per se, due to current through the series arrangement of the LED circuit cell in the case that the LED or group of LEDs of the circuit cell are short circuited, is less than 1.3 Watt. As is well known, the dissipated power is the square of the voltage over the resistor divided by the resistance value. Given the maximum voltage over the resistor (e.g. the given rated maximum power supply voltage and optional resistors in series with the resistor), this means that the heat dissipation requirement implicitly defines a minimum resistance value, assuming for example that all non-resistors are short circuited. In a further embodiment a more restrictive requirement of no more than 1.1 Watt dissipation may be imposed. This makes it possible to provide intrinsic safety in ambients of up to 80 degrees centigrade.

Preferably no active sensing circuits such as amplifiers or comparators with inputs coupled to the LED circuit cell are used in the LED circuit cell to protect against heating. Including such circuits in a large number of LED circuit cells in a display array would make a display cost-ineffective. Moreover, intrinsic safety would require a design that accounts for failures in such circuits, such as short circuited inputs and failure to amplify. By using a switching type PTC such active sensing circuits and intrinsic safety of their use are made unnecessary for intrinsic safety of the LED display.

The limitation of electric current is realized by remote heating of the switching type PTC by the resistors and not by heat dissipation in the switching type PTC itself. In an embodiment the switching temperature of the switching type PTC of at least one and preferably all LED circuit cells is so high that the switching type PTC will not switch off due to excess heat generated by a failing adjoining LED circuit cell, and more preferably by all adjoining LED circuit cell if they all fail, when the LED or group of LEDs of the LED circuit cell itself does not fail. In this way, the LED circuit cell can be kept functioning with intrinsic safety even if adjoining LED circuit cells fail, so that information display remains possible.

In an embodiment the resistor or group of resistors of each LED circuit cell has a resistance values and a heat contact to the switching type PTC so that heat generated by the resistor or group of resistors per se, due to a current through the series arrangement in excess of a first current value will heat the switching type PTC to a temperature above the switching temperature. On the other hand heat generated by the switching type PTC due to a current through the series arrangement at the first current value per se is insufficient to heat the switching type PTC to a temperature above the switching temperature.

In order to provide for selection between display of different image content the series arrangement of each LED circuit cell comprises a switching transistor in series with the switching type PTC, the further switch or group of switches and the LED or group of LEDs. The switching type PTC is connected in series with this switching transistor.

In an embodiment the group of LEDs in a LED circuit cell comprises a plurality of LEDs in series. In this way a larger part of the current through the LED circuit cell is converted into light than when only one LED is used. This makes it possible to combine a safe margin for protection against explosion risk with lower heat dissipation during normal operation.

In an embodiment the group of resistors comprises a plurality of discrete resistors in parallel. This makes it possible to use smaller resistors. Smaller resistors can be heated to higher temperature than larger resistors without compromising intrinsic safety.

BRIEF DESCRIPTION OF THE DRAWING

These and other objects and advantageous aspects will become apparent from a description of exemplary embodiments, using the following figures.

DETAILED DESCRIPTION OF THE DISCLOSURE

Figure 1:
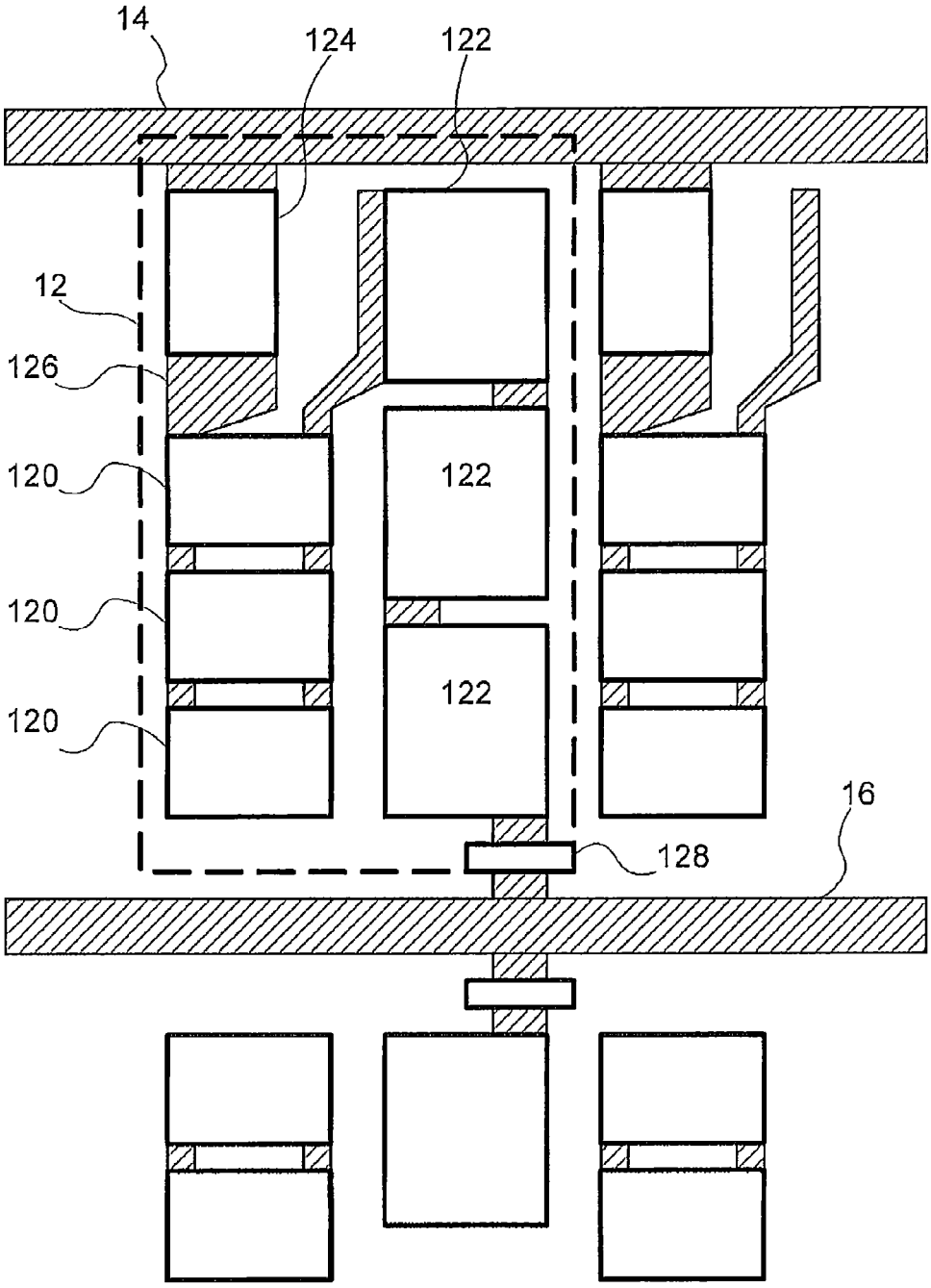
FIG. 1 shows part of a LED display device.

FIG. 1 shows part of an intrinsically safe LED display device, comprising a mounting board with an array of LED circuit cells 12 and power supply lines 14, 16. Each LED circuit cell 12 comprises a group of resistors 120, a group of LEDs 122, a switching type PTC 124. In each LED circuit cell 12 the group of resistors 120, the group of LEDs 122, the switching type PTC 124 are connected in series between power supply lines 14, 16. An electronic switch 128 is provided in series with this series arrangement. The electronic switch may have a control electrode (not shown) connected to a driver circuit (not shown). In another embodiment the electronic switch 128 may be shared by the series arrangements of different LED circuit cells, or it may be provided for one series arrangement only.

The array of LED circuit cells may be a two-dimensional matrix with rows and columns. Herein each LED circuit cell may form a different pixel. An image can be displayed by controlling the LED cells of different pixels according to the content of the image to be displayed.

Although LED circuit cells with three LEDs in series are shown, it should be appreciated that a different number of LEDs may be used. In an embodiment different LED circuit cells in the device may contain mutually different numbers of LEDs in series. For example, a first part of the LED circuit cells may contain three LEDs in series, as shown in FIG. 1 and a second part may have only two LEDs in series. Different types of LEDs, for different colors for example, may be used in the first and second part respectively. In this way, intrinsically safe circuits containing an array with mutually different types of LEDs can be realized. The array of LED circuit cells 12 may consist of rows of LED circuit cells 12, the rows forming segments of a seven segment display (three horizontal bar segments above each other and two pairs of vertical bars connecting the tips of successive pair of the horizontal bars). In addition, the array may comprise further LED circuit cells in the areas in the "eyes" of the seven segments. Alternatively, an array with LED circuit cells arranged in horizontal rows and vertical columns may be used. Resistors 120 are of a type with less than 2000 square millimetre surface area. This is easily the case for most normal commercially available resistors. Resistors of 1 Watt maximum power rating may be used for example.

A switching type PTC 124 is a device having a temperature dependent resistance that increases sharply within a narrow temperature range, the resistance variation due to temperature dependence outside that range being much less than in that range. The centre of the range is called the transition temperature. Switching type PTCs 124 with a transition temperature of a hundred and five degrees centigrade may be used for example, or another transition temperature in a range between eighty and a hundred and twenty degrees centigrade.

An embodiment of such a switching type PTC 124 is a body of electrically non-conductive polymer matrix with embedded electrically conductive grains, and electrodes coupled to the body. The polymer matrix presses the embedded grains in mutual contact with each other at low temperature. Thus, conductive paths between the electrodes are provided through the grains and their mutual contacts, leading to a low resistance value. Thermal expansion of the polymer matrix removes the contact between the grains when the temperature of the matrix exceeds a threshold value. Thus, the conductive paths between the electrodes through the grains are interrupted, leading to a high resistance value at temperatures above the threshold value. Such devices are known per se. They are available for example from Bourns, under the type name "Multifuse", as a device that switches as a fuse. Multifuse type MF-MSMF020 may be used for example. The conventionally known fuse operation (current limitation) requires that the Multifuse heats itself above the transition temperature due to electrical heat generation in the Multifuse. In contrast, in the present invention switching is due to external heating of the Multifuse, by the group of resistors 120, that is, the part of the LED circuit cell that could give rise to a risk of setting off an explosion.

Another embodiment of such a switching type PTC 124 is a polycrystalline body of material that is ferroelectric below a threshold temperature and non-ferroelectric above the threshold temperature. In this case conductive paths between crystal grains are available below the threshold temperature, but the disappearance of ferroelectric properties above the threshold temperature gives rise to energy barriers between the grains that sharply reduces conductivity.

In operation, an electrical voltage is applied between power supply lines 14, 16. A power supply circuit (not shown) coupled to power supply lines 14, 16 may be provided for this purpose. The power supply circuit may be designed according to the requirements of intrinsic safety, so that it is intrinsically safe that its output power supply voltage will be below a predetermined value. Also, the power supply circuit may limit the overall current to all LED circuit cells together.

In operation, the electronic switches 128 of selected LED circuit cells 12 are opened, so that electrical current flows between the power supply lines 14, 16 through group of resistors 120, a group of LEDs 122 and a switching type PTC 124 of these LED circuit cells. The electronic switches 128 of non-selected LED circuit cells 12 are closed, so that no electrical current flows in these LED circuit cells. A driver circuit (not shown) may be provided with connections to the control electrodes (not shown) of the electronic switches to select the LED circuit cells. Optionally the circuit contains further resistors between the driver circuit and control electrodes to limit driver currents to intrinsically safe levels.

In normal operation, the power associated with the electrical current flow between the power supply lines 14, 16 in the selected LED circuit cells is at least partly converted into light, by the group of LEDs 122. Another part is converted into heat, for example by the group of resistors 120. This heat gives rise to a local temperature increase in the LED circuit cell. The power level used for producing light under, summed over all LED circuit cells may be 30 Watt for example. The LED circuit cell is configured so that the increased temperature remains below the threshold temperature of switching type PTC 124 at normal ambient conditions (ambient temperature below sixty degrees centigrade, wind speed zero or higher). The local temperature increase is a result of a balance between heat supply due to dissipated electrical power and heat flow from the LED circuit cell due to thermal conduction, convection, radiation etc.

To provide for intrinsic safety, operation in the case of conceivable circuit failure must also be considered. In the case of LEDs, this requires consideration of operation when the LEDs form short circuits. When failures arise in the circuit, a larger part of the power associated with the electrical current may be converted into heat than during normal operation. When the LEDs short circuit, this power also increases due to current increase. This creates a potential risk that the temperature will rise above the highest safe temperature TS at which the risk of setting off an explosion due to local heating can be excluded if the display is exposed to an explosive gas. This level TS may be taken to be a hundred and thirty five degrees centigrade over a large area for example.

Power limitation by means of resistors 120 can easily be used to prevent that unsafe temperatures arise when a single cell fails. When the resistors 120 have a resistance value R of 220 Ohm each and the power supply voltage Vmax is 10.5 Volt maximum for example, the worst case dissipated power in each resistor ($Vmax^2/R$) is below a half Watt, which easily provides intrinsic safety if only a single LED circuit cell fails.

The resistors form the point where the highest temperature in a malfunctioning LED circuit cell would be reached, if the LED circuit cell operated in isolation. Other parts of the LED circuit cell would have lower temperatures. Therefore, limiting the power dissipation to intrinsically safe levels by means of the resistors provides the simplest way of providing intrinsic safety. However, when a plurality of adjoining LED circuit cells fail, excess heat dissipation in these LED circuit cells will give to mutual heating of the LED circuits cells. This means that the temperature rise in the LED circuit cell will be higher than the expected temperature rise due to the current in the cell on its own. Therefore the protection afforded by the series resistors is insufficient to provide intrinsic safety.

Intrinsic safety against this effect is realized by means of switching type PTC 124 and group of resistors 120. Due to the current through the LED circuit cell 12, the group of resistors 120 in the LED circuit cell generates heat, which is conducted to switching type PTC 124 via the electrical conductor line 128 between the group of resistors 120 and the switching type PTC 124. Heat from adjoining LED circuit cells is also conducted to the switching type PTC 124. This heat raises the temperature in switching type PTC 124. When there is a normal voltage drop over group of LEDs 122, this temperature rise is insufficient to reach the transition temperature of switching type PTC 124.

But when the voltage drop over group of LEDs 122 disappears due to a device or circuit fault, the heat dissipated by group of resistors 120 rises to a level limited by resistors 120. When the adjoining LED circuit cells also fails, the temperature of switching type PTC 124 is raised to the transition temperature of switching type PTC 124. As a result switching type PTC 124 becomes highly resistive, which reduces the power dissipated in LED circuit cell 12 restricting its local temperature to a level below that at which a risk of explosion exists.

Figure 2:
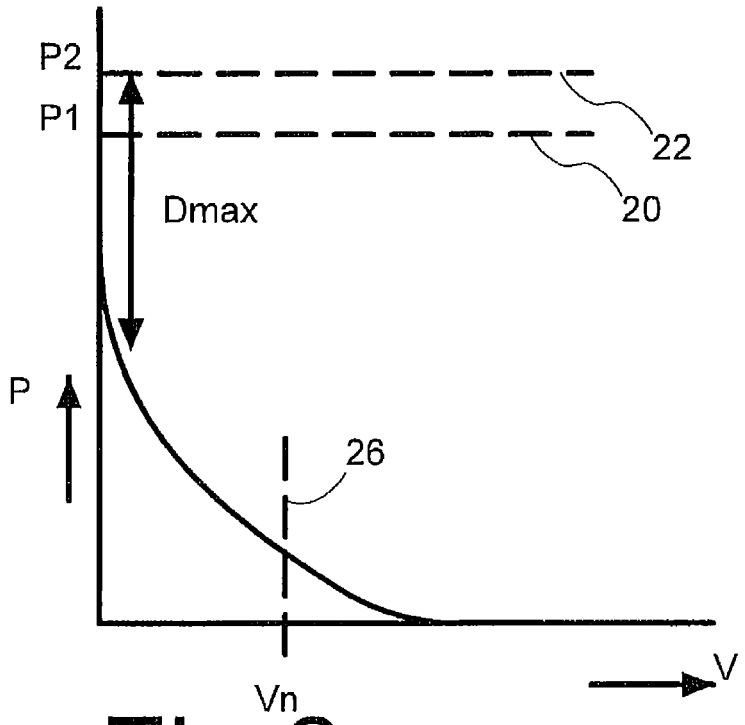
FIG. 2 illustrates heat generation as a function LED voltage.

FIG. 2 illustrates resistor heat generation power P in a LED circuit cell as a function of the voltage drop V over group of LEDs 122. The nominal voltage drop Vn during normal operation is indicated by a vertical dashed line 26. The temperature rise of switching type PTC 124 increases with heat generation power P. A first dashed line 20 indicates a first power level P1 corresponding to the transition temperature of switching type PTC 124. A second dashed line 22 indicates a second power level P2 corresponding to heating to the lowest temperature at which there is a risk of explosion. The second power level P2 lies above the first power level P1 (P2>P1). As can be seen, the dissipated power in the LED circuit cell is limited below first power level P1 by the resistors, avoiding the risk of explosion if the LEDs in an individual LED circuit cell are short circuited.

Resistors of 220 Ohm each may be used for example, in combination with a power supply voltage of 9.5 Volt between power supply lines 14, 16 and a normal voltage drop of 2.5 Volts per LED. In this case the nominal current through the LEDs is about 27 mA and the current through each resistor is about 9 mA (18 mWatt dissipated power). Alternatively, or in different LED circuit cells, LEDs with a voltage drop of 2.2 or 3.5 Volt may be used. In the LED circuit cells with LEDs with 3.5 Volt voltage drops, two LEDs may be used in series instead of three. The power supply voltage is intrinsically below 10 Volt. When this voltage is combined with short circuits of the LEDs, the current is about 45 mA per resistor (452 mWatt). In one example, the resistance of switching type PTC 124 is less than one Ohm at ambient temperature. The trip current of switching type PTC 124, i.e. the current at which it switches due to its own heating is 400 mA at an ambient temperature of 23 Centigrade and 200 mA at an ambient temperature of 85 Centigrade.

Conventionally, the resistance values may be selected based on (a) maximum safe power dissipation Pmax with respect to heating at maximum input voltage Vm when the LEDs are short circuited: $R>Vm^2/Pmax$, (Pmax may taken to be 1.3 Watt for ambient temperatures up to 40 Centigrade and 1.1 Watt for ambient temperatures up to 80 Centigrade) (b) operation at at most ⅔ the specified maximum power PRmax of the resistor itself: $R>3*Vm^2/2*PRmax$ (PRmax depends on the type of resistor used) and (c) the minimum required operational current IL and voltage VL, in this case of the LEDs: $R<3*(Vn-VL)/IL$, where Vn is the nominal supply voltage, which is slightly below Vm. In an embodiment a nominal voltage of 9.5 Volts and a maximum voltage of 10 Volts is used. This eases design conditions such as the isolation distance across the resistor, making it possible to choose from a larger number of resistor types.

A short circuit of the LEDs of one LED circuit cell leads to an increase in power dissipation of that is below the intrinsically safe level, due to the resistors. However, the net heat supply to the resistors of a LED circuit also depends on whether the LEDs of surrounding LED circuit cells are short circuited. This net heat supply is due mainly to contributions from adjoining cells. In a worst case situation this shifts the second power level P2 in a LED display cell corresponding to heating to the lowest temperature at which there is a risk of explosion, down by an amount Dmax. When the LED cell operates normally, its power dissipation is below the shifted down level. But when the LEDs of the LED circuit cell are also short circuited the resulting power dissipation may lead to unsafe temperatures.

The switching type PTC is used to provide intrinsic safety for this type of malfunctioning. It should be noted that the temperature at the switching type PTC of the LED circuit cell may differ from that of the resistors. Prima facie, this could give rise to a safety concern that the resistors might become unsafely hot without detection by the switching type PTC. But because heat generated by the adjoining LED circuit cells reaches both the switching type PTC and the resistors directly, the effect of this heat does not increase the temperature difference. Furthermore a tight thermal coupling between the PTC and the resistors through their electrical connection keeps the difference small. Preferably, the conductor track between the PTC and the resistors is made as wide as possible in view of the contacts to the PTC and the resistors. At the same time the switching temperature of the switching type PTC is set so high that no switch off occurs due to heating from adjoining LED circuit cells if the LED circuit cell itself does not fail. In this way it is avoided that the LED circuit cell is switched off only due to its neighbours.

Figure 3:
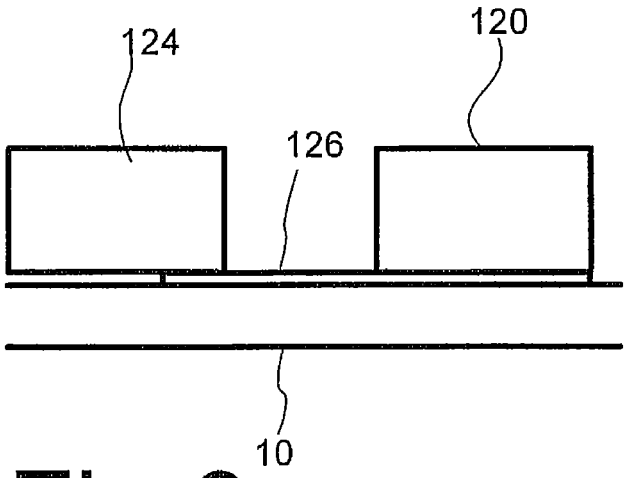
FIG. 3 shows a cross-section of a LED display device.

FIG. 3 shows a cross-section of part of a LED circuit cell, showing a resistor from group of resistors 120 and switching type PTC 124 as well as the interconnecting conductor 126 on the mounting board 10. In operation, heat generated by the resistor flows from the resistor to switching type PTC 124 via interconnecting conductor 126.

By using a switching type PTC 124 in each LED circuit cell, the series arrangements in the LED circuit cells need not be connected to amplifiers, comparators etc. This excludes the risk that heat generated by such devices, when they malfunction, could raise the temperature above the level at which an explosion can be set off.

Within a LED circuit cell 12, the temperature of group of resistors 120 may be higher than that of the switching type PTC 124 in the LED circuit cell. This is because the heat is generated in group of resistors 120 and this heat flows to switching type PTC 124. The temperature difference will be denoted by DT. DT may be five or ten centigrade for example. The transition temperature of switching type PTC 124 should lie below the lowest explosion safe temperature level TS by at least DT.

Adjoining LED circuit cells may influence each other's temperature. Hence account should be taken of the possibility that the temperature rise in a LED circuit cell could be higher than that due to heat from the LED circuit cell itself, because of contributions from adjacent LED circuit cells. By using a switching type PTC 124 that is thermally coupled to the group of resistors 120, current can be switched off as well if a dangerous temperature arises due to a combination of heat generation in the LED circuit cell and heat from outside the LED circuit cell, even if dissipation due to the electric current of the LED circuit cell alone is insufficient to produce a dangerous temperature.

In the example of FIG. 1, each group of resistors 120 consists of three resistors in the electrically coupled in parallel.

Instead a group consisting only of a single resistor may be used. By using a plurality of resistors heat dissipation can be spatially distributed near switching type PTC 124. Use of a plurality of resistors in parallel makes it easier to make the resistors operate in an intrinsically safe way. Although an example with three resistors in parallel has been shown, it should be appreciated that a different number greater than one also produces this effect. Resistors are considered to be sufficiently safe against short circuit failure so that there is no need to protect against explosion risks in the case of short circuit failure. Preferably, the group of resistors 120 adjoins the switching type PTC 124 in the electrical series arrangement of the LED circuit cell, without other components of the series arrangement in between. This also has the effect that the temperature difference between the resistors and switching type PTC 124 is made smaller.

In the example of FIG. 1, each group of LEDs 122 consists of three LEDs electrically coupled in series. Instead a group consisting of only one LED 122 may be used, two LEDs in series, or more LEDs in series. By using a plurality of LEDs in series, relatively less of the energy associated with the electric current is converted into heat than when one LED is used. This means that relatively less power needs to be lost to heat in the group of resistors 120 during normal operation.

Although an embodiment has been shown wherein each LED circuit cell in the array contains only a single switching type PTC in series with a resistor or resistors and LED or LEDs, it should be appreciated that more than one a single switching type PTC may be used. A plurality of switching type PTCs could be used in parallel. A plurality of switching type PTCs may be used in series in the LED circuit cell, each located for example between other components, such as the resistors, of the LED circuit cell and components of a respective one of the adjoining LED circuit cells. This may be used to account for local heat flows. But it has been found that one switching type PTC per cell suffices in most circumstances. Use of no more than one switching type PTC per cell in at least part of the cells (and preferably in a majority of the cells or even all cells) reduces circuit cost and cell area.

The invention claimed is:

1. An intrinsically safe LED display device with a two-dimensional array of LEDs, comprising a mounting board, a spatial array of separate LED circuit cells located on the mounting board, each LED circuit cell comprising an electrical series arrangement of a switching type PTC, a resistor or group of resistors, and a LED or group of LEDs, located in a same relative location in each LED circuit cell, the switching type PTC being in thermal contact with the resistor or group of resistors of the circuit cell, wherein the switching type PTC of each LED circuit cell has a switching temperature between 80 and 125 degrees centigrade, wherein the resistor or group of resistors of each LED circuit cell has a resistance value and a heat contact to the switching type PTC of the LED circuit cell so that heat dissipated in the LED circuit cell per se, due to current through the series arrangement of the LED circuit cell in the case that the LED or group of LEDs of the circuit cell are short circuited, is insufficient to raise the temperature of the switching type PTC of the LED circuit cell above its switching temperature when the LED or group of LEDs of none of the LED circuit cells adjoining the LED circuit cells are short circuited, whereas the resistance value and the heat contact are such that heat generated by a combination of heat generated by the series arrangement the particular one of the LED circuit cells and its adjoining cells, when the LED or group of LEDs of the particular one of the LED circuit cells and its adjoining cells are short-circuited, is sufficient to raise the temperature of the switching type PTC of the particular one of the LED circuit cells above the switching temperature.

2. A LED display device according to claim 1, comprising a power supply circuit, the electrical series arrangements of the LED circuit cells being coupled in parallel to the power supply circuit, wherein the power supply circuit is arranged to keep the power supply voltage below a predetermined value at which the LEDs of the circuit cells are protected from destruction by overvoltage.

3. A LED display device according to claim 1, wherein the spatial array is a two dimensional array of the LED circuit cells.

4. A LED display device according to claim 1, wherein the resistor or group of resistors of each LED circuit cell has a resistance value so that heat dissipated in the LED circuit cell per se, due to current through the series arrangement of the LED circuit cell in the case that the LED or group of LEDs of the circuit cell are short circuited, is less than 1.3 Watt.

5. A LED display device according to claim 1, wherein the series arrangement of each LED circuit cell comprises a switching transistor in series with the switching type PTC, the further switch or group of switches and the LED or group of LEDs.

6. A LED display device according to claim 1, wherein the group of LEDs comprises a plurality of LEDs in series.

7. A LED display device according to claim 1, wherein the group of resistors comprises a plurality of discrete resistors in parallel.

8. A LED display device according to claim 1, wherein the spatial array comprises a spatial row of spatial LED circuit cells on the mounting board, respective ones of the LED circuits being located within a respective one of the LED circuit cells in the row, the switching type PTC, the further switch or group of switches and the LED or group of LEDs of each LED circuit all being located within the LED circuit cell of the LED circuit.

9. A LED display device according to claim 8, wherein the spatial array comprises rows and columns of spatial LED circuit cells on the mounting board, respective ones of the LED circuits each being located within a respective one of the LED circuit cells in the rows and columns.

10. A LED display device according to claim 1, wherein the switching type PTC comprises an electrically non-conductive polymer matrix with embedded grains of electrically conductive material that are kept in electric contact with each other by the polymer matrix below the switching temperature.

11. An intrinsically safe LED display device with a two-dimensional array of LEDs, comprising a mounting board, a spatial array of separate LED circuit cells located on the mounting board, each LED circuit cell comprising an electrical series arrangement of a switching type PTC, a resistor or group of resistors, and a LED or group of LEDs, located in a same relative location in each LED circuit cell, the switching type PTC being in thermal contact with the resistor or group of resistors of the circuit cell, wherein the switching type PTC of each LED circuit cell has a switching temperature between 80 and 125 degrees centigrade, wherein the switching temperature of the switching type PTC of a particular one of the LED circuit cells is so high that heat generated by the series arrangement of a further one of the LED circuit cells adjoining the particular one of the LED circuit cells, in the case when the LED or the group of LEDs of the further one of the LED circuit cells is short circuited, is insufficient to raise the temperature of the switching type PTC of the particular one of the LED circuit cells above its switching temperature, when the LED or group of LEDs of the particular one of the LED circuit cells is not short-circuited, whereas the switching temperature of the switching type PTC of a particular one of the LED circuit cells is so low that heat generated by a combination of heat generated by the series arrangement the particular one of the LED circuit cells and its adjoining cells, when the LED or group of LEDs of the particular one of the LED circuit cells and its adjoining cells are short-circuited, is sufficient to raise the temperature of the switching type PTC of the particular one of the LED circuit cells above the switching temperature.

12. A LED display device according to claim 11, comprising a power supply circuit, the electrical series arrangements of the LED circuit cells being coupled in parallel to the power supply circuit, wherein the power supply circuit is arranged to keep the power supply voltage below a predetermined value at which the LEDs of the circuit cells are protected from destruction by overvoltage.

13. A LED display device according to claim 11, wherein the resistor or group of resistors of each LED circuit cell has a resistance value so that heat dissipated in the LED circuit cell per se, due to current through the series arrangement of the LED circuit cell in the case that the LED or group of LEDs of the circuit cell are short circuited, is less than 1.3 Watt.

14. An intrinsically safe LED display device with a two-dimensional array of LEDs, comprising:

a mounting board, a spatial array of separate LED circuit cells located on the mounting board, each LED circuit cell comprising an electrical series arrangement of a switching type PTC, a resistor or group of resistors, and a LED or group of LEDs, located in a same relative location in each LED circuit cell, the switching type PTC being in thermal contact with the resistor or group of resistors of the circuit cell, wherein the switching type PTC of each LED circuit cell has a switching temperature between 80 and 125 degrees centigrade, wherein the switching temperature of the switching type PTC of a particular one of the LED circuit cells is so high that heat generated by all adjoining ones of the LED circuit cells adjoining the particular one of the LED circuit cells, in the case when the LEDs or the groups of LEDs of all the adjoining ones of the LED circuit cells are short circuited, is insufficient to raise the temperature of the switching type PTC of the particular one of the LED circuit cells above its switching temperature, when the LED or group of LEDs of the particular one of the LED circuit cells is not short-circuited, whereas the switching temperature of the switching type PTC of a particular one of the LED circuit cells is so low that heat generated by a combination of heat generated by the series arrangement the particular one of the LED circuit cells and all the adjoining cells, when the LED or group of LEDs of the particular one of the LED circuit cells and the adjoining cells are short-circuited, is sufficient to raise the temperature of the switching type PTC of the particular one of the LED circuit cells above the switching temperature.

15. A LED display device according to claim 14, comprising a power supply circuit, the electrical series arrangements of the LED circuit cells being coupled in parallel to the power supply circuit, wherein the power supply circuit is arranged to keep the power supply voltage below a predetermined value at which the LEDs of the circuit cells are protected from destruction by overvoltage.

16. A LED display device according to claim 14, wherein the resistor or group of resistors of each LED circuit cell has a resistance value so that heat dissipated in the LED circuit cell per se, due to current through the series arrangement of the LED circuit cell in the case that the LED or group of LEDs of the circuit cell are short circuited, is less than 1.3 Watt.

17. A method of providing an intrinsically safe LED display device with an array of LED circuit cells, each cell comprising a series connection of a switching type PTC, a resistor or group of resistors, and a LED or a group of LEDs, the method comprising providing intrinsic safety for each LED circuit cell individually, by limiting a worst case current through the LED circuit cell by means of a resistor or group of resistors in series with the LED or group of LEDs of the circuit cell;

providing intrinsic safety for mutual heating of adjoining LED circuit cells wherein the LEDs or groups of LEDs are short circuited, by means of switching type PTCs with a switching temperature between 80 and 125 degrees centigrade, in series with the resistors or group of resistors of the LED circuit cells respectively, in thermal contact with the resistor or group of resistors of the LED circuit cell.

* * * * *